US005993507A

United States Patent [19]

Baum et al.

[11] Patent Number: 5,993,507

[45] Date of Patent: Nov. 30, 1999

[54] COMPOSITION AND PROCESS FOR METAL INJECTION MOLDING

[75] Inventors: Louis W. Baum, Little Falls; Maryann Wright, Utica, both of N.Y.

[73] Assignee: Remington Arms Co., Inc., Madison, N.C.

[21] Appl. No.: 08/999,335

[22] Filed: Dec. 29, 1997

[51] Int. Cl.[6] ..... B22F 3/10

[52] U.S. Cl. ..... 75/252; 419/23; 419/36

[58] Field of Search ..... 419/36, 23; 75/252

[56] References Cited

U.S. PATENT DOCUMENTS

| | | | |
|---|---|---|---|
| 3,620,690 | 11/1971 | Bergstrom | 29/182 |
| 3,940,269 | 2/1976 | Bergstrom | 75/214 |
| 4,602,953 | 7/1986 | Wiech et al. | 75/228 |
| 4,948,426 | 8/1990 | Kato e tal. | 419/23 |
| 4,964,907 | 10/1990 | Kiyota et al. | 75/235 |
| 4,968,739 | 11/1990 | Nakanishi et al. | 524/322 |
| 5,067,979 | 11/1991 | Kiyota et al. | 75/243 |
| 5,091,022 | 2/1992 | Achikita et al. | 148/104 |
| 5,098,648 | 3/1992 | Kiyota et al. | 419/23 |
| 5,141,554 | 8/1992 | Kijima | 75/246 |
| 5,268,140 | 12/1993 | Rutz et al. | 419/54 |
| 5,279,640 | 1/1994 | Ogura et al. | 75/343 |
| 5,641,920 | 6/1997 | Hens et al. | 75/228 |

OTHER PUBLICATIONS

Kulkarni, 1990, "Study of MIM Feedstocks Made with Powders of Different Particle Sizes" Proceedings of the 1990 Powder Metallurgy Conference and Exhibition.

Joo et al., 1992, pp. 1467–1475, "Metal Injection Molding of Mixed Powder with Coarse and Fine Iron Powder" 30, (12), Journal of the Korean Institute of Metals and Materials.

Irving, 1987, V 14 N 660 p. 31, "Starting Small, Metal Injection Molding is Facing a Rapidly Expanding Demand" Metalworking News.

*Primary Examiner*—Daniel J. Jenkins

*Attorney, Agent, or Firm*—Huntley & Associates

[57] ABSTRACT

A composition comprising a mixture of coarse and fine iron powder and at least one densification enhancing additive for economically producing metal injection molding components.

17 Claims, No Drawings

COMPOSITION AND PROCESS FOR METAL INJECTION MOLDING

BACKGROUND OF THE INVENTION

This invention relates generally to the metal injection molding (MIM) industry, and more specifically, to a composition for use in MIM processes.

MIM processes have generally been expensive in the past due to the relatively high cost of the fine metal powders used in such processes. This cost is about an order of magnitude higher than that of more coarse powders used in conventional press and sinter powder metallurgical processes.

These fine powders have heretofore been considered necessary because the fine particle size provides an extremely high particle surface area. This high surface area is a primary factor in known MIM compositions and processes to allow for densification to a level sufficient to provide satisfactory mechanical and physical properties in the parts produced by MIM processes. Molded and debinderized MIM components typically have about 35–40% porosity and a large amount of shrinkage, or densification, is necessary to reduce the porosity of the finished component to about 1–5% in order to obtain the requisite properties.

The use of more coarse powders, such as those commonly used in powder metallurgy processes, or a mixture of coarse and fine powders, is possible using known MIM compositions. However, the use of coarse powders theoretically requires extending sintering times as much as 10,000 times the time required for fine powders in order to achieve the requisite densification. Therefore, it is desirable, in order to make MIM components more economical to produce, to provide a composition which will allow the use of fine and coarse powders in MIM processes without requiring such extended sintering times.

Known MIM compositions and processes utilize grain boundary or surface diffusion controlled sintering processes. These processes depend on surface energy as the driving force for sintering. Therefore, the fine MIM-type powders exhibit greater shrinkage than the coarser P/M-type powders because of the larger surface area which is characteristic of the fine MIM-type powders. While these surface energy dependent solid state sintering processes work well with the fine powder compositions presently used in MIM processes, new compositions and processes are needed to take advantage of the economic benefits of using coarse powders.

SUMMARY OF THE INVENTION

The present invention provides a metal injection molding feedstock composition comprising a mixture of coarse and fine iron powder, polymeric binder and at least one additive selected from the group consisting of ferrite stabilizer and iron alloys having a melting point at least about 100° F. below a desired sintering temperature, the at least one additive being present in an amount effective to permit densification of the composition, during sintering, to greater than about 94% of the theoretical density of the composition.

DETAILED DESCRIPTION OF THE INVENTION

The present invention uses a blend of coarse and fine iron powder. Particle size of fine MIM powders is typically less than about 20 $\mu$m. For the coarser P/M powders, the particle size is within the range of about from 20 to 150 $\mu$m. It is much less expensive and time consuming to manufacture the coarser P/M powders, therefore, it is desirable to use as much of the P/M powders as possible while still obtaining satisfactory mechanical and physical properties in the finished components.

The present invention is based on the discovery that densification of a MIM composition can be facilitated by either stabilizing a phase that has a high sintering rate or by providing for the formation of a transient liquid phase. For iron, the volume diffusivity at 1670° F. (the allotropic $\alpha$ to $\gamma$ transformation temperature) is approximately 300 times higher for the body-centered cubic (BCC) ferrite ($\alpha$) phase than for the face-centered cubic (FCC) austentite ($\gamma$) phase. Therefore, a composition which stabilizes the BCC phase provides for much more rapid solid-state sintering. This sintering process is known as enhanced solid-state sintering, or ESSS. The amount of densification increases as the amount of ferrite stabilized at the sintering temperature increases.

In transient liquid phase sintering (TLPS), a "transient liquid" forms between an additive and the base powders, or between mixed powders, during heating to the sintering temperature. The transient liquid which forms has a high solubility in the solid and then becomes part of the alloy matrix during sintering by a process known as diffusional homogenization. The densification associated with TLPS depends on the amount of liquid formed and the length of time the liquid exists as a separate material during sintering. The higher the amount of liquid and the longer it is present during sintering, the greater the resulting densification of the sintered components.

For TLPS, a master alloy additive can be used which produces a liquid phase during sintering as a method to promote diffusion, homogenization and densification. A wide variety of such additives can be used, provided that the additive has a melting point at least about 50 Fahrenheit degrees, and preferably at least about 100 Fahrenheit degrees, and especially at least about 200 below the solid state sintering temperature of the mixture. Iron silicon and iron phosphorus alloys have been found to be For example, a master alloy of iron and 17% silicon can be admixed with equal amounts of coarse and fine iron powders to achieve an overall composition of iron and 3% silicon. The Fe-17% Si ferrosilicon melts at approximately 2250 ° F., well below the desired sintering temperature range of about 2300–2450° F. The ferrosilicon melts and rapidly diffuses into the iron, changing composition (through homogenization) to one that is stable but with a melting point higher than the sintering temperature. This homogenized alloy solidifies, but significant densification has occurred. Further densification occurs during the isothermal sintering phase. This results in a manufactured component with a markedly higher density (lower porosity) than a similar part without the transient liquid component present. The component also has improved mechanical and physical properties, approaching the properties of components formed from wrought material.

In those embodiments of the invention using a ferrite stabilizer, in general, about from 2% to 10% of ferrite stabilizer can be used in the present blends of iron powder and ferrite stabilizer. A variety of materials can be used to stabilize the BCC ferrite phase, including Mo, Si, P, Al, Cr, Sn, Ti, W and Zn. Among these materials, Si and P also promote the formation of a "transient liquid", i.e., a liquid having a high solubility in the solid which disappears during sintering by diffusional homogenization. Such "transient liquids" can also increase the densification of parts based on the amount of the liquid formed and the length of time the liquid exists during the sintering process. Mo is a preferred ferrite stabilizer.

The ferrite stabilizer should be present in an amount effective to promote densification during sintering. While the specific amount of ferrite stabilizer necessary to promote densification can vary depending on the particular ferrite stabilizer used, it has been found that at least about 2% of the ferrite stabilizer is required to promote densification. The upper limit of the amount of ferrite stabilizer used can vary depending on the particular ferrite stabilizer used. However, more than about 10% ferrite stabilizer has little or no beneficial effect on densification rate and can adversely affect both densification rate as well as other mechanical and physical properties of the resulting alloy.

The feedstock compositions of the present invention further comprise at least one polymeric binder. A wide variety of such binders can be used, as are known in the metal injection molding art, including, for example, waxes, polyolefins such as polyethylenes and polyproplyenes, polystyrenes, polyvinyl chloride, polyetheylene carbonate, polyethylene glycol and microcrystalline wax. The particular binder will be selected on the basis of compatibility with powder components, and ease of mixing and debinding. Still other known factors in selecting a binder include toxicity, shelf life, strength, lubricity, biostability, and recyclability. The concentration of the binder is typically about from 25 to 50 volume %, based on the total composition. About from 30 to 40 volume % has been found to be particulary satisfactory.

The properties to consider when evaluating the usefulness of the sintered articles prepared according to the present invention include the density, the ultimate tensile strength (UTS), the yield strength (YS) and the HRB hardness. Another measure of the quality of the sintering is the amount of interconnecting porosity (ICP) and its relationship to the total porosity (TP) present in the sintered component. ICP is that porosity that is connected to an outside free surface. Low amounts of ICP as well as a low ICP/TP ratio are desirable.

Many structural components, including many firearm components, which require good mechanical and physical properties are presently made from an iron composition containing 2% nickel. Therefore, this composition was chosen as the benchmark against which the mechanical and physical properties of other compositions according to the present invention were compared.

The present invention is further illustrated by the following Examples and Comparative Examples, in which parts and percentages are by weight.

EXAMPLES 1–6 AND COMPARATIVE EXAMPLES A–H

In Comparative Example A, 100% fine powder Fe-2% Ni was pressed in a mold to form a standard test bar. The pressed test bar was sintered at 2125° F. for 1 hour. Standard testing yielded the benchmark properties shown in Table 1. In Comparative Examples B–D, test bars of the same Fe-2% Ni composition were made utilizing a mixture of 50% fine and 50% coarse powders. The resulting bars were tested, and the mechanical properties were mediocre. Even increasing sintering time and temperature, in Comparative Examples C and D, failed to produce satisfactory results for this composition when a mixture of 50% fine/50% coarse powders was used.

In Comparative Example E, a composition was prepared comprising Fe-3% Si. This composition was obtained by mixing a Fe-17% Si alloy with iron powder to achieve an overall composition of Fe-3% Si. As in Comparative Example A, a test bar was made using 100% fine iron powder. After pressing and then sintering for about 1 hour at about 2125° F., a temperature below that at which a "transient liquid" is formed, the density was 99.1% of the theoretical density and the other properties were excellent as well, as shown in Table 1.

In Comparative Example F, a test bar was made using with the same alloy as Comparative Example E, but with a mixture of 50% fine and 50% coarse powders. The composition was pressed and sintered at 2125° F. for 1 hour, and the resulting density was only about 85% of theoretical. However, In Example 1, in which the procedure of Comparative Example F was repeated, but using a sintering temperature of about 2500° F., a composition of 50% fine/50% coarse powder Fe-3% silicon produced tensile properties approaching those of the same alloy made with 100% fine powder and comparable to the benchmark Fe-2% nickel alloy.

In Comparative Examples G and H, a Fe-5% Mo composition was prepared. In Comparative Example G, a 100% fine powder mixture was used and sintered at 2125° F. for 1 hour with the resulting density being about 98% of theoretical and the other properties were excellent, as shown in Table 1. In Example H, with a mixture of 50% fine/50% coarse powder, sintering at the low temperature of 2125° F. for 1 hour resulted in a density of 85% of theoretical density with poor mechanical and physical properties. However, in Example 3, in which the same proceedure was repeated, but with sintering at a temperature of 2500° F., these comditions accelerated shrinkage to achieve a density of 95% of theoretical with excellent mechanical properties as well as low TP, ICP and ICP/TP ratio, as shown in Table 1.

In Examples 5 and 6, alloys of Fe-Si-Mo were prepared. Specifically, alloys of Fe-3% Si-1% Mo (Example 5) and Fe-2% Si-2%Mo (Example 6) were prepared. As in Comparative Examples E and F, the Fe—Si portion of the mixture was obtained by using a Fe-17% Si master alloy and mixing with appropriate amounts of iron powder to obtain the overall levels of Si as reported in Table 1. Both alloys were tested using 50% fine/50% coarse powder mixtures. These alloys, when sintered at 2500° F. for 2 hours, resulted in properties which were comparable to the properties of the separate Fe-3% Si and Fe-5% Mo alloys, as shown in Table 1.

TABLE I

Examples 1–6, Comparative Example A

| Example | Comp. | Powder Particle Size | Sinter Temp ° F. | Sinter Time Hours | Density g/cm$^3$ | % Theor Density | UTS psi | YS psi | % Elong | HRB | % TP | % ICP | ICP/TP |
|---|---|---|---|---|---|---|---|---|---|---|---|---|---|
| A | Fe-2% Ni | 100% fine | 2125 | 1 | 7.50 | 95.2 | 55,000 | 30,000 | 25.0 | 55 | 4.8 | 0.100 | 0.021 |
| B | | 50% fine– | 2125 | 1 | 6.69 | 84.8 | 23,710 | 14,480 | 6.5 | 8 | 15.5 | 6.49 | 0.418 |

TABLE I-continued

Examples 1–6, Comparative Example A

| Example | Comp. | Powder Particle Size | Sinter Temp ° F. | Sinter Time Hours | Density g/cm$^3$ | % Theor Density | UTS psi | YS psi | % Elong | HRB | % TP | % ICP | ICP/TP |
|---|---|---|---|---|---|---|---|---|---|---|---|---|---|
| C | | 50% crse 50% fine–50% crse | 2500 | 1 | 6.78 | 85.9 | 32,630 | 16,570 | 13.5 | 6 | — | — | — |
| D | | 50% fine–50% crse | 2500 | 2 | 6.95 | 88.1 | 34,610 | 17,020 | 16.0 | 12 | 10.5 | 1.91 | 0.182 |
| E | Fe-3% Si | 100% fine | 2125 | | 7.6 | 99.1 | 75,000 | 50,000 | 25.0 | 85 | — | — | — |
| F | Fe-3% Si | 50% fine–50% crse | 2125 | 1 | 6.53 | 85.1 | 31,490 | 28,470 | 3.0 | 42 | 9.0 | 1.9 | 0.211 |
| 1 | | 50% fine–50% crse | 2500 | 1 | 7.34 | 95.7 | 65,870 | 47,800 | 13.0 | 75 | — | — | — |
| 2 | | 50% fine–50% crse | 2500 | 2 | 7.42 | 96.7 | 69,590 | 49,980 | 14.0 | 80 | 2.7 | 0.28 | 0.102 |
| G | Fe-5% Mo | 100% fine | | | 7.80 | 98.0 | 59,000 | 31,000 | 34.0 | 66 | — | — | — |
| H | Fe-5% Mo | 50% fine–50% crse | 2125 | 1 | 6.74 | 84.7 | 33,790 | 21,370 | 9.5 | 17 | 11.3 | 2.59 | 0.229 |
| 3 | | 50% fine–50% crse | 2500 | 1 | 7.56 | 95.0 | 50,590 | 27,970 | 30.5 | 54 | — | — | — |
| 4 | | 50% fine–50% crse | 2500 | 2 | 7.62 | 95.7 | 51,040 | 28,270 | 30.5 | 57 | 4.2 | 0.22 | 0.052 |
| 5 | Fe-3% Si-1% Mo | 50% fine–50% crse | 2500 | 2 | 7.43 | 96.7 | 69,800 | 48,200 | 22.0 | 76 | — | — | — |
| 6 | Fe-2% Si-2% Mo | 50% fine–50% crse | 2500 | 2 | 7.43 | 94.3 | 63,800 | 42,000 | 28.0 | 74 | — | — | — |

We claim:

1. A metal injection molding feedstock composition comprising a mixture of iron powder and least about 10% coarse iron powder, polymeric binder and at least one additive selected from the group consisting of ferrite stabilizer and iron alloys having a melting point at least about 100 ° F. below a desired sintering temperature, the at least one additive being present in an amount effective to permit densification of the composition, during sintering, to greater than about 94% of the theoretical density of the composition.

2. A composition of claim 1 wherein the at least one additive is a ferrite stabilizer.

3. A composition of claim 2 wherein the ferrite stabilizer is at least one metal selected from the group consisting of Mo, Si, P, Al, Cr, Sn, Ti, W and Zn.

4. A composition of claim 2 wherein the at least one ferrite stabilizer is present in amount of about from 2 to 10% by weight.

5. A composition of claim 4 wherein the at least one ferrite stabilizer comprises up to about 5% by weight of Mo.

6. A composition of claim 1 wherein the at least one additive is an iron-silicon alloy having a melting point of less than about 2250° F.

7. A composition of claim 6 wherein the iron—silicon alloy comprises less than about 10% silicon.

8. A composition of claim 7 wherein the iron—silicon alloy comprises about 3% silicon.

9. A composition of claim 1 wherein the at least one additive comprises a mixture of a ferrite stabilizer selected from the group consisting of Mo, Si, P, Al, Cr, Sn, Ti, W and Zn and an iron—silicon alloy having a melting point of less than about 2250 ° F.

10. A composition of claim 9 comprising up to about 2% Mo and up to about 3% Si.

11. A composition of claim 9 comprising about 2% Mo and about 2% Si.

12. A composition of claim 9 comprising about 1% Mo and about 3% Si.

13. A composition of claim 1 comprising up to about 50% coarse iron powder.

14. A metal injection molding process comprising the steps of:

a. admixing a feedstock comprising a mixture of coarse and fine iron powder, polymeric binder and at least one additive selected from the group consisting of ferrite stabilizer and iron alloys having a melting point at least about 100° F. below a desired sintering temperature, the at least one additive being present in an amount effective to permit densification of the composition, during sintering, to greater than about 94% of the theoretical density of the composition;

b. molding the feedstock into an unsintered blank;

c. removing the polymeric binder; and d. sintering the unsintered blank at a time and a temperature sufficient to allow densification of the unsintered blank into a sintered component.

15. A process of claim 14 wherein the at least one additive is a ferrite stabilizer selected from the group consisting of Mo, Si, P, Al, Cr, Sn, Ti, W and Zn.

16. A process of claim 14 wherein the at least one additive is an iron-silicon alloy having a melting point of less than about 2250° F.

17. A process of claim 14 wherein the sintering is carried out at a temperature of about from 2300 to 2500° F. for a period of about from 45 minutes to 2 hours.

* * * * *